US010202265B2

(12) United States Patent
Hall et al.

(10) Patent No.: US 10,202,265 B2
(45) Date of Patent: Feb. 12, 2019

(54) WINCH CABLE WIPER ASSEMBLY

(71) Applicants: David R. Hall, Provo, UT (US); Daniel Madsen, Vineyard, UT (US); Benjamin Taylor, Provo, UT (US); Lloyd J. Wilson, Herriman, UT (US)

(72) Inventors: David R. Hall, Provo, UT (US); Daniel Madsen, Vineyard, UT (US); Benjamin Taylor, Provo, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 142 days.

(21) Appl. No.: 15/390,916

(22) Filed: Dec. 27, 2016

(65) Prior Publication Data

US 2018/0179032 A1 Jun. 28, 2018

(51) Int. Cl.

| | |
|---|---|
| ***B66D 1/30*** | (2006.01) |
| ***B66D 1/38*** | (2006.01) |
| ***B66D 1/00*** | (2006.01) |
| ***B66D 1/12*** | (2006.01) |
| ***B66D 1/28*** | (2006.01) |

(52) U.S. Cl.

CPC ..... *B66D 1/38* (2013.01); *B66D 1/00* (2013.01); *B66D 1/12* (2013.01); *B66D 1/28* (2013.01)

(58) Field of Classification Search

CPC ..... B66D 1/36; B66D 1/46; B66D 1/50
USPC ..... 242/615.4
See application file for complete search history.

(56) References Cited

U.S. PATENT DOCUMENTS 2,157,024 A * 5/1939 Smith ..... G01F 23/0023 15/220.4
2,703,423 A * 3/1955 Hunt ..... E21B 33/08 100/171
3,788,605 A * 1/1974 Johnson ..... B66D 1/00 251/166
3,825,197 A * 7/1974 Sturgeon ..... B65H 54/2812 242/419.5
3,999,240 A * 12/1976 Uchida ..... B65H 75/44 15/256.6
4,132,973 A * 1/1979 Orme ..... B64D 1/00 114/244
4,422,208 A * 12/1983 Rohrbaugh ..... D07B 7/12 15/236.09
4,570,285 A * 2/1986 Skelton ..... B63B 21/14 15/104.04
4,610,402 A * 9/1986 Corbett ..... B29C 53/8016 156/425
4,920,439 A * 4/1990 Bordignon ..... G11B 15/605 226/196.1
4,922,361 A * 5/1990 Bordignon ..... G11B 15/60 226/196.1
5,297,755 A * 3/1994 Felde ..... G11B 23/08757 226/196.1
5,386,882 A * 2/1995 Friend ..... A46B 15/00 15/256.6

(Continued)

*Primary Examiner* — Emmanuel M Marcelo

(57) ABSTRACT

A winch is described comprising a rotatable drum for winding and unwinding a first cable therefrom. The winch contains a cable-wiping apparatus with one or more actuators are activated when the drum rotates in a direction for winding the first cable onto the drum. A mechanical force may be transmitted from the actuator to a second cable that is operatively connected to a wiper clamp. The wiper clamp compresses around the first cable when the cable is pulled in.

20 Claims, 12 Drawing Sheets

(56) References Cited

U.S. PATENT DOCUMENTS

| | | | | |
|---|---|---|---|---|
| 6,634,588 | B1 * | 10/2003 | Jackson | B66D 1/00 242/323 |
| 7,412,745 | B2 * | 8/2008 | Connolly | B08B 1/02 15/256.6 |
| 9,586,237 | B2 * | 3/2017 | Calvet | B08B 1/002 |
| 2007/0044267 | A1 * | 3/2007 | Connolly | B66B 7/1284 15/256.6 |
| 2012/0175576 | A1 * | 7/2012 | Xydias | B66D 1/38 254/336 |
| 2015/0083879 | A1 * | 3/2015 | Hoffend | A63J 1/028 248/332 |
| 2015/0284230 | A1 * | 10/2015 | Hall | B66D 5/32 254/357 |

* cited by examiner

WINCH CABLE WIPER ASSEMBLY

TECHNICAL FIELD

The present disclosure relates generally to the field of winches and hoists. More specifically, the present disclosure relates to an apparatus for cleaning a winch cable.

BACKGROUND

Winches are hauling or lifting devices, which may pull in or let out a cable. The winch pulls in the cable by winding the cable around a horizontal rotating drum, and lets out the cable by unwinding the cable from said drum. Winding the cable uniformly around the drum is optimal so that the cable does not bunch up around a single location on the drum and potentially jam the winch during winding. The cable may accumulate dirt, mud, debris, and/or other materials as it pulls in a load, which can accrue and buildup around the cable as it is wound around the drum. Such buildup can disrupt uniform winding of the cable around the drum, and increase the likelihood of the winch jamming. Additionally, said materials may accumulate in other locations on the winch such as within a fairlead, cable guide, around a tensioner, in the gears, and/or other places where buildup may be unwanted. Thus, a need exists to reduce the likelihood that said materials would accumulate around the drum and other places within the winch. Embodiments disclosed herein may improve performance of winches by reducing the likelihood that said materials would accumulate in unwanted locations within the winch.

SUMMARY OF THE INVENTION

Disclosed herein is a winch, comprising one or more actuators controlled by unidirectional rotation of a drum rotating about a horizontal axis within the winch. Rotation of the drum may be powered by an electric power source. In one embodiment, said electric power source may also power the one or more actuators, which may cause a wiping or clamping apparatus to tighten around a cable as it is pulled in through a cable guide. The cable guide may direct the cable as it is wound around the drum. The actuation mechanism may be dormant when the cable is let out from the winch, and when the winch is not in use. Thus, the wiping or clamping apparatus may only provide active wiping when pulling in the cable.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

In the following detailed description, numerous specific details are provided for a thorough understanding of the various embodiments disclosed herein. The embodiments disclosed herein can be manufactured without one or more of the specific details, or with other methods, components, materials, etc. In addition, in some cases, well-known structures, or characteristics may be combined in any suitable manner in one or more alternative embodiments.

Figure 1A:
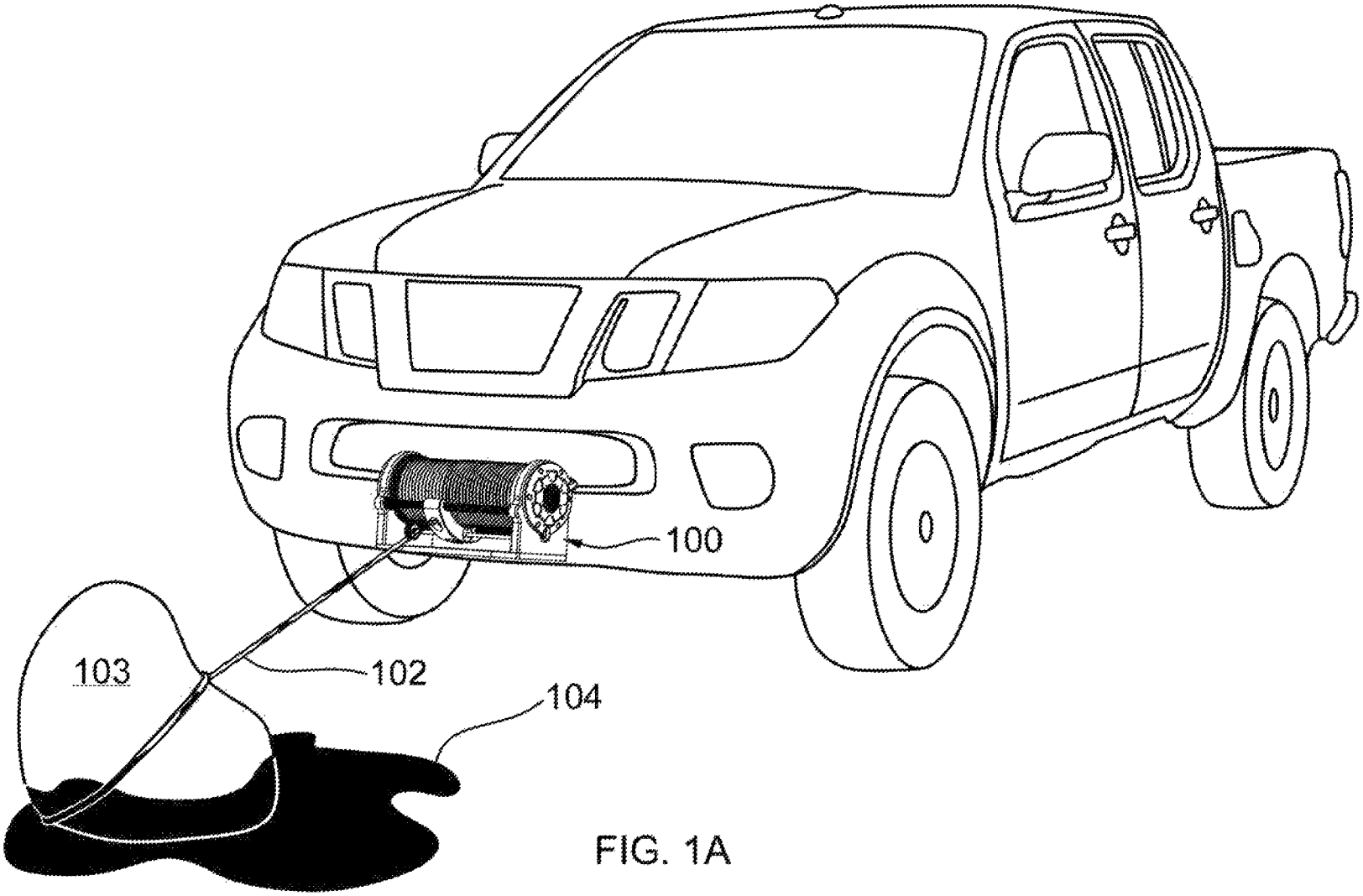
FIG. 1A depicts a winch, according to one embodiment, with a cable that is partially submerged in a muddy material.

FIG. 1A depicts a winch 100, according to one embodiment, with a cable 102 that is partially submerged in a muddy material 104. The winch 100 may be used to pull in a load 103. A variety of undesirable muck such as said muddy material 104 might, at times, stick to the cable 102 as it is being pulled in, and accumulate within the winch 100.

Figure 1B:
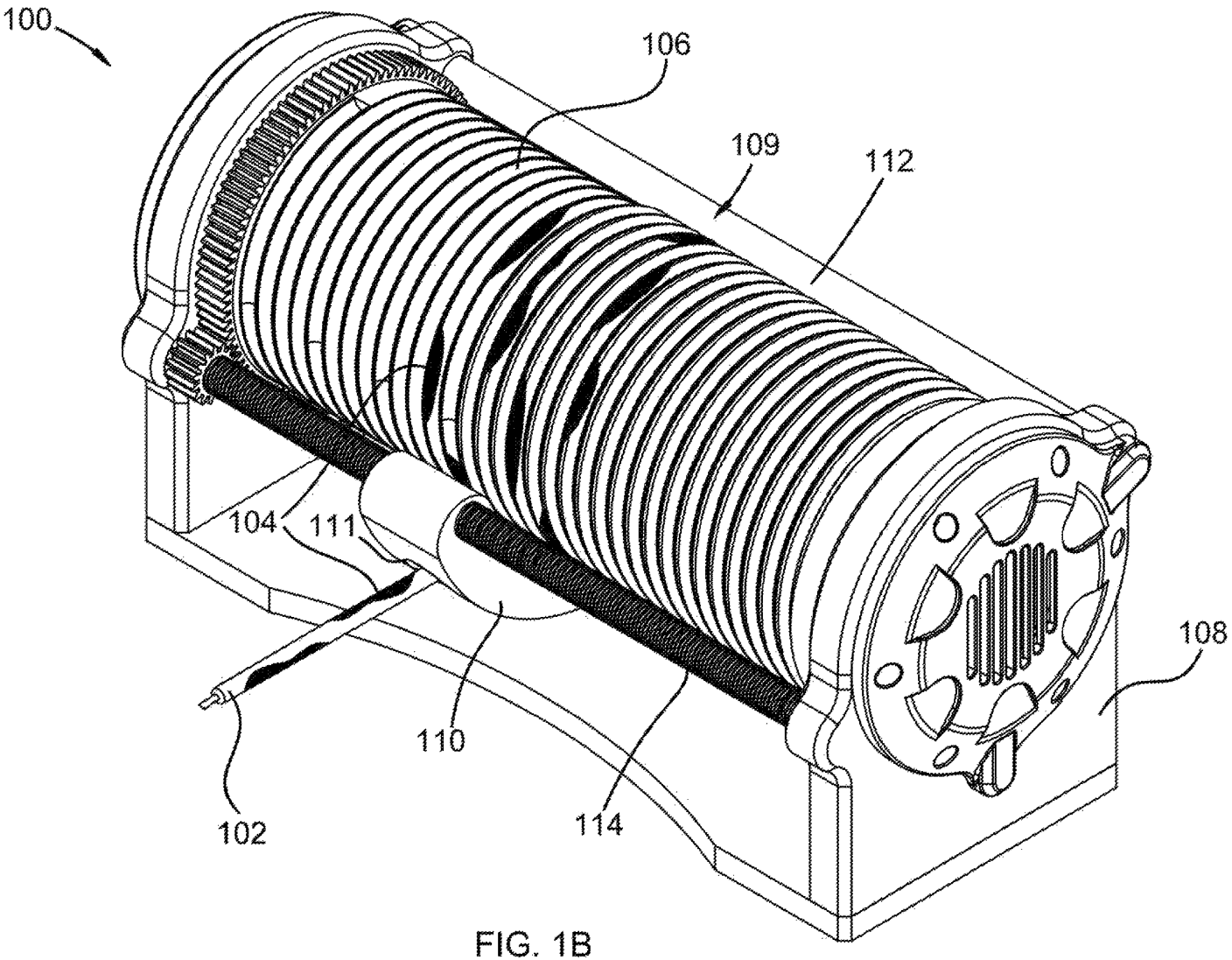
FIG. 1B is a close-up view of the winch of FIG. 1A, which shows an accumulation of muddy material at several locations on the cable, according to one embodiment.

FIG. 1B is a close-up view of the winch 100 of FIG. 1A, which shows an accumulation of muddy material 104 at several locations on the cable 102, according to one embodiment. The winch 100 comprises a rotatable drum 109 mounted within a frame 108 and supported for rotation about the drum's 109 longitudinal axis. The winch 100 may include a cable guide 110 mounted on the frame 108 adjacent the drum 109 for positioning the cable 102 onto the drum 109. The guide 110 may include one or more guide rods 114 disposed substantially parallel to the longitudinal axis of the drum 109. The winch 100 may also include a support rod 112 for supporting the frame 108. The guide 110 may comprise a fairlead 111 through which the cable 102 passes during winding and unwinding.

The cable 102 is connected to the drum 109 such that the cable 102 is wound around the drum 109 when the cable 102 is pulled in, and when the cable 102 is unwound from the drum 109 the cable 102 is let out. The drum 109, in many embodiments, is shaped as a right circular cylinder; however, the drum 109 can be of any variety shapes including an elliptic cylinder, a parabolic cylinder, a hyperbolic cylinder, an oblique cylinder, a cuboid, a rounded cuboid, a triangular prism, and/or any of a variety of other shapes. In some embodiments, the drum 109 may include a plurality of helical grooves 106 to assist in uniformly winding the cable 102 onto the drum 109.

Optimally, the cable 102 will be uniformly distributed along the drum 109 rather than being bunched together in one location on the drum 109 in order to reduce the likelihood that a bunched up cable 102 will hinder proper rotation of the drum 109 by catching on the one or more guide rods 114. However, the muddy material 104, dirt, and/or other debris that accumulates in the winch 100 can disrupt the uniform distribution of the cable 102 as it is wound around the drum 109. Such disruptions in the distribution of the cable 102 can cause the cable 102 to jam the winch 100 such that it is unable to pull in and/or let out the cable 102.

The cable 102 may comprise any of a variety materials compatible with use on a winch 100, such as hemp, linen, flax, cellulose, carbon, wool, hair, feathers, cotton, coir, jute, straw, silk, sisal, polymers, nylon, Dyneema®, Kevlar®, rayon, orlon, polypropylene, polyesters, polyethylene, aramids, acrylics, copper, iron, steel, stainless steel, bronze, nichrome, carbon, solder, titanium, zinc, silver, gold, tungsten, aluminum, and/or other suitable material.

Figure 2:
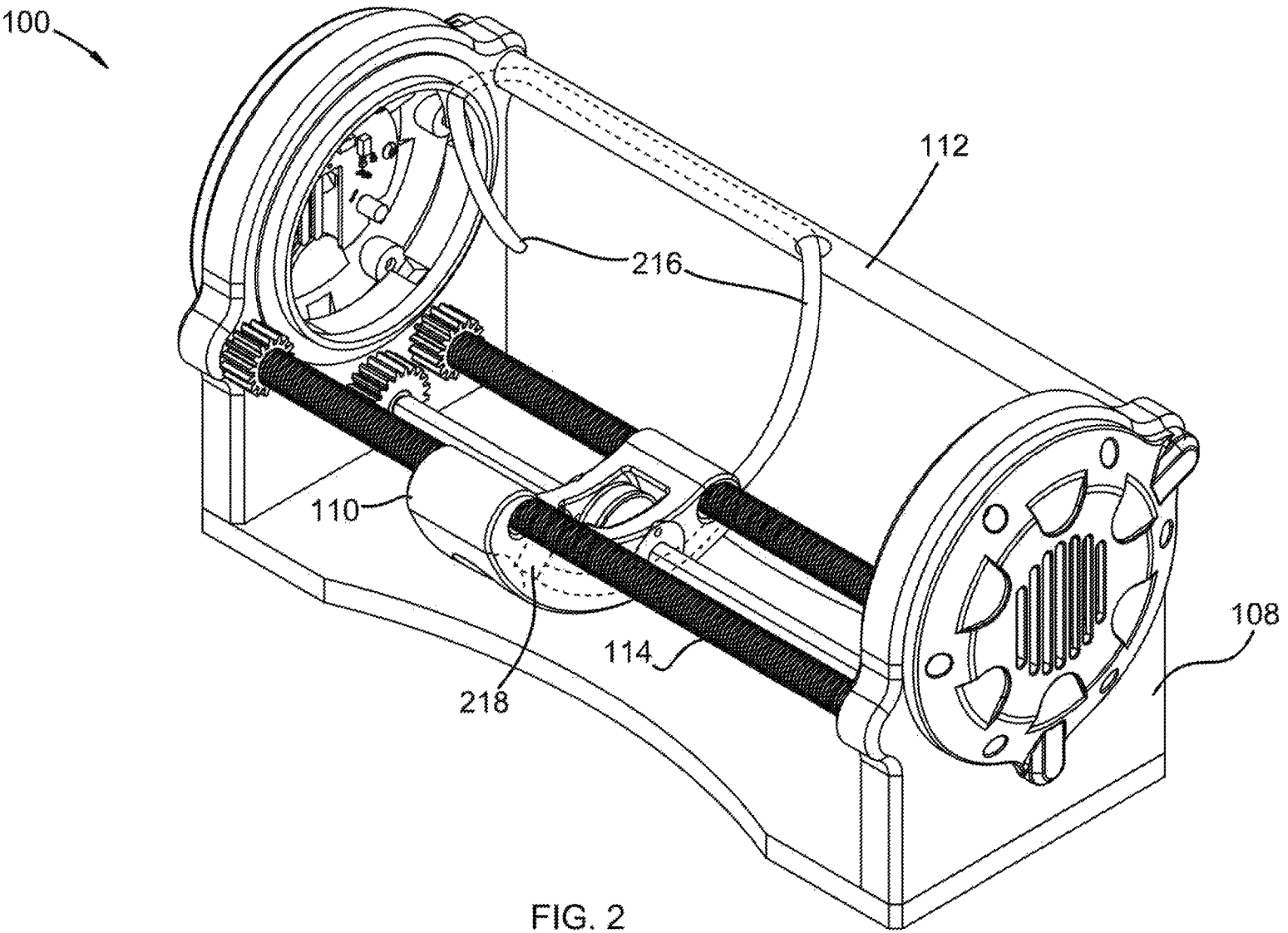
FIG. 2 is an isometric view of the winch with the drum removed, according to one embodiment.

FIG. 2 is an isometric view of the winch 100 with the drum 109 (see FIGS. 1A and 1B) removed, according to one embodiment. The support rod 112 may be hollow, according to various embodiments, and house one or more electric wires 216. In one embodiment, the electric wires 216 may feed into the guide 110 and connect to at least one actuator 218. The other end of the electric wires 216 may pass through the frame and connect to an electricity source (not shown). The electricity source may be within the drum 109 (see FIGS. 1A and 1B) or contained within an alternative location within the winch 100, according to various embodiments. In another embodiment, the electricity source that powers rotation of the drum 109 (see FIGS. 1A and 1B) is external to the winch 100. The electric wires 216 may be of sufficient length such that as the guide 110 moves along the guide rods 114 that the electric wires 216 do not impede the guide's 110 movement.

Figure 3:
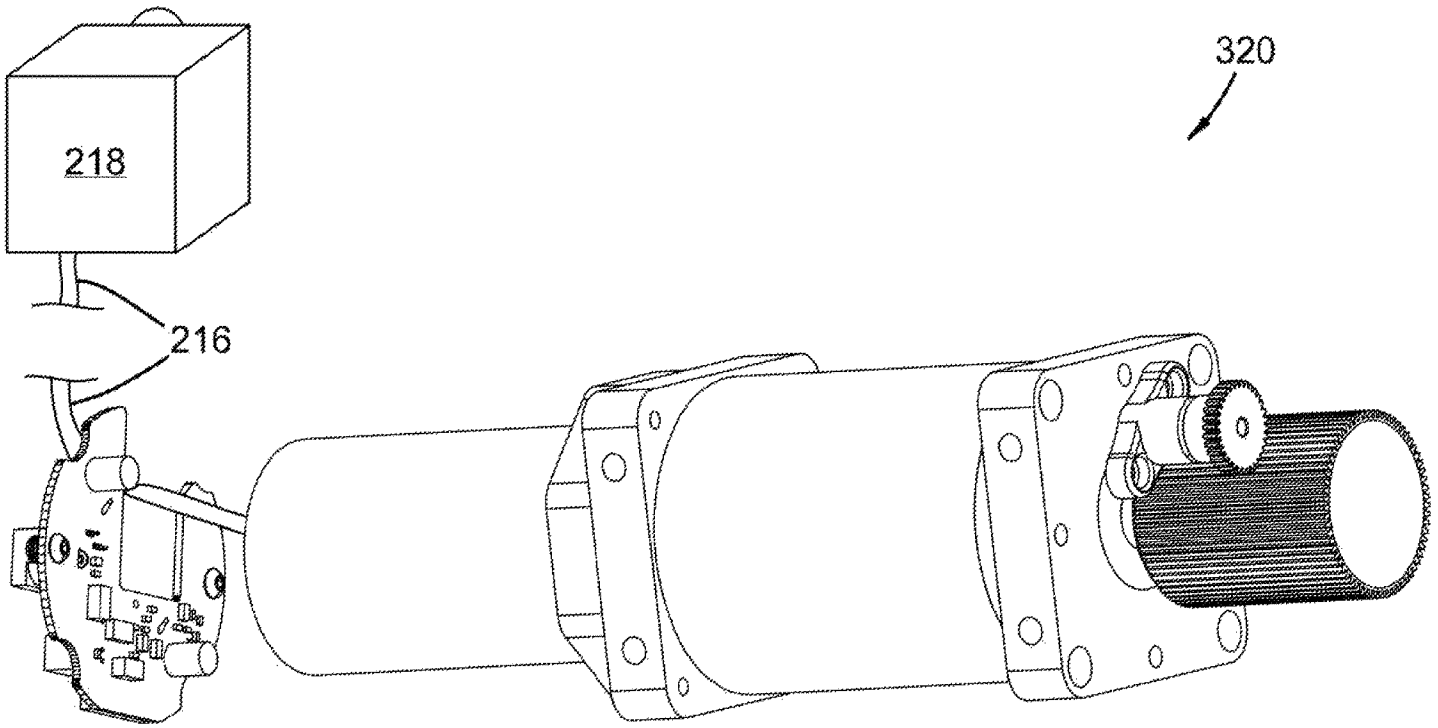
FIG. 3 is an embodiment of a tension motor of the winch, from which the electrical wire exits and eventually connects to the actuator.

FIG. 3 is an embodiment of a tension motor 320 of the winch 100, from which the electrical wires 216 exits and eventually connects to the actuator 218. An electricity source may be contained within the tension motor 320 and operatively connected to the electrical wires 216.

Figure 4A:
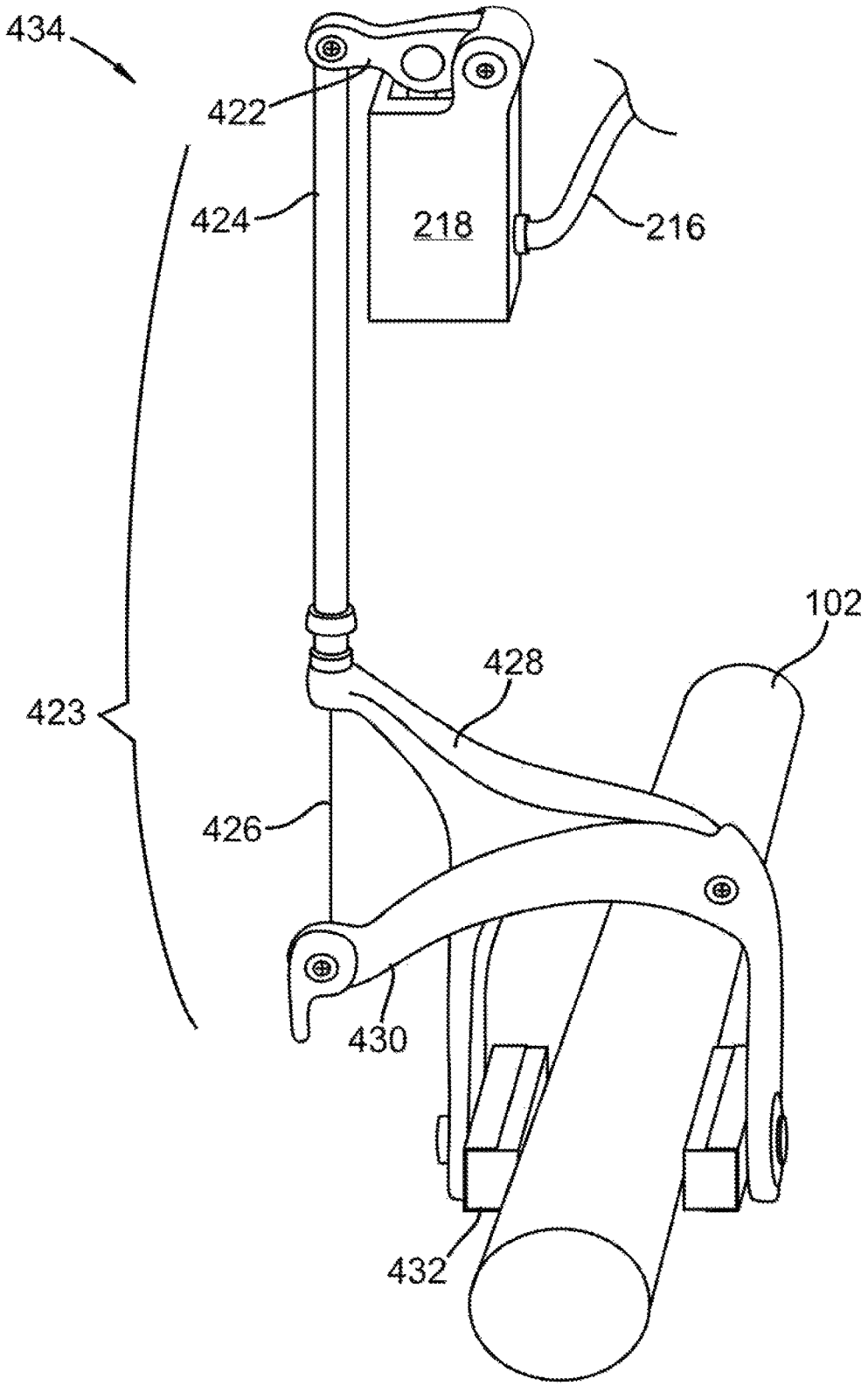
FIG. 4A is an isometric view of a cable-wiping apparatus, according to one embodiment, comprising an actuator.

FIG. 4A is an isometric view of a cable-wiping apparatus 434, according to one embodiment, comprising an actuator 218. The actuator 218 may be connected to an electricity source with electric wires 216. The actuator 218 may convert electrical energy into mechanical torque. The mechanical torque may move a lever 422 that is connected to a metal cable 423 comprising an inner cable 426 positioned within an outer cable housing 424 for at least a portion of the length of the metal cable 423. The cable-wiping apparatus 434 may include a wiper clamp such as a side-pull clamping mechanism, a center-pull clamping mechanism, a cantilever, or any other suitable clamping apparatus, according to various embodiments, that can tighten around the cable 102 and wipe off debris as the cable 102 enters the winch. In one embodiment, a top caliper arm 428 and a bottom caliper arm 430 may direct the movement of one or more clamp shoes 432. The outer cable housing 424 of the metal cable 423 may be attached to the top caliper arm 428 and the inner cable 426 may be attached to the bottom caliper arm 430. The mechanical torque generated by the actuator 218 may control the metal cable 423 such that the top caliper arm 428 and the bottom caliper arm 430 are moved closer together. The movement of the top caliper arm 428 and bottom caliper arm 430 may cause the cable-wiping apparatus 434 to tighten around the cable 102 by squeezing the one or more clamp shoes around the cable 102. In one embodiment, the metal cable 423 may be a flexible cable comprising a composite outer cable housing, a longitudinal incompressible layer such as a helical winding or sheaf of steel wire, and/or a barrel adjuster to lengthen or shorten the cable housing such as a Bowden cable.

Figure 4B:
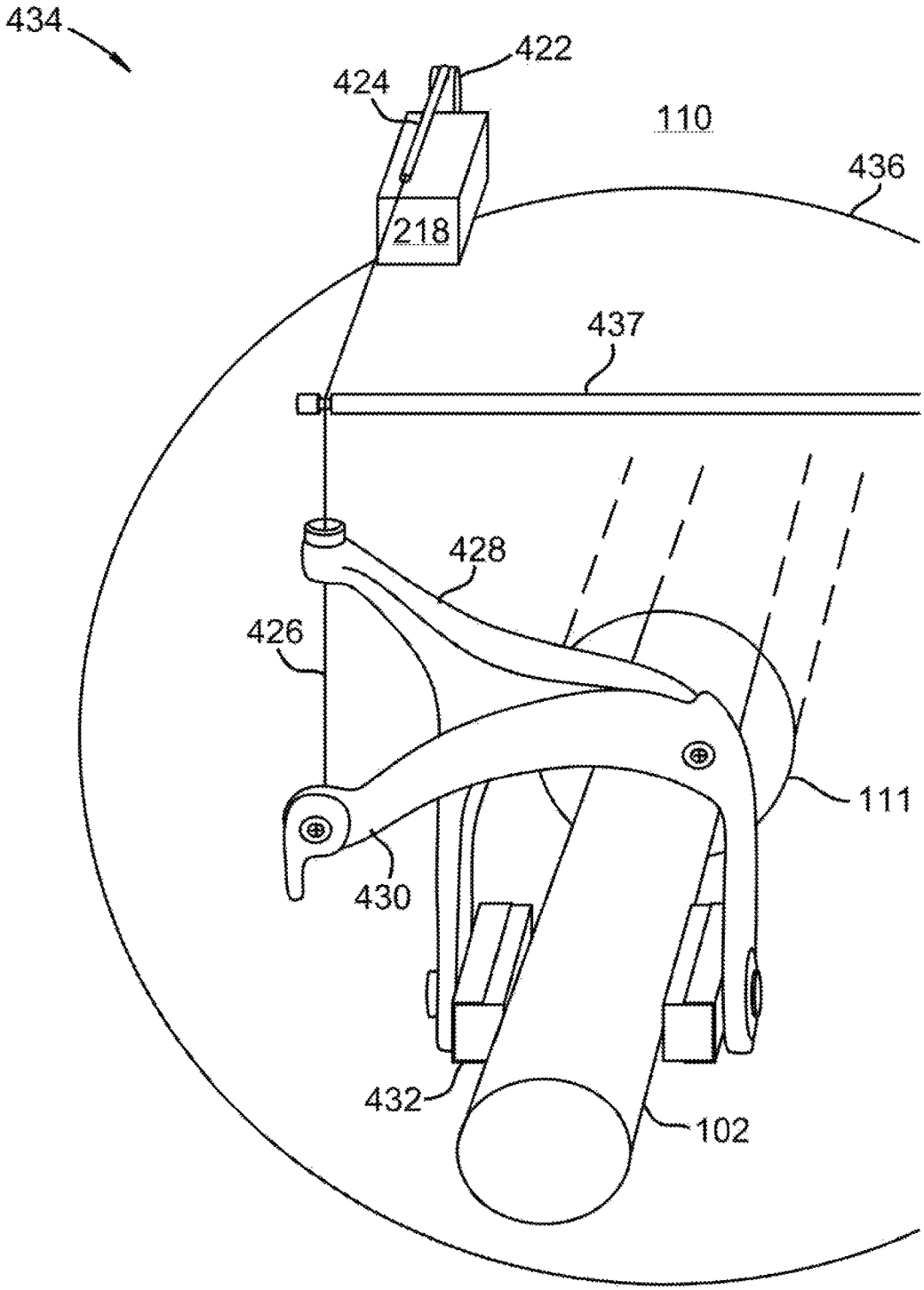
FIG. 4B is cross sectional view of an orifice of a fairlead that includes an alternative arrangement of the actuator and cable-wiping apparatus of FIG. 4A, according to one embodiment.

FIG. 4B is cross sectional view of an orifice of a fairlead 111 that includes an alternative arrangement of the actuator 218 and cable-wiping apparatus 434 of FIG. 4A, according to one embodiment. The fairlead 111 may include a cavity 436 within the guide 110 wherein a rod 437 may be used to direct the direction of the metal cable 423 in order to improve the leverage for moving the top caliper arm 428 and bottom caliper arm 430 such that the one or more clamp shoes 432 tighten around the cable 102.

Figure 5A:
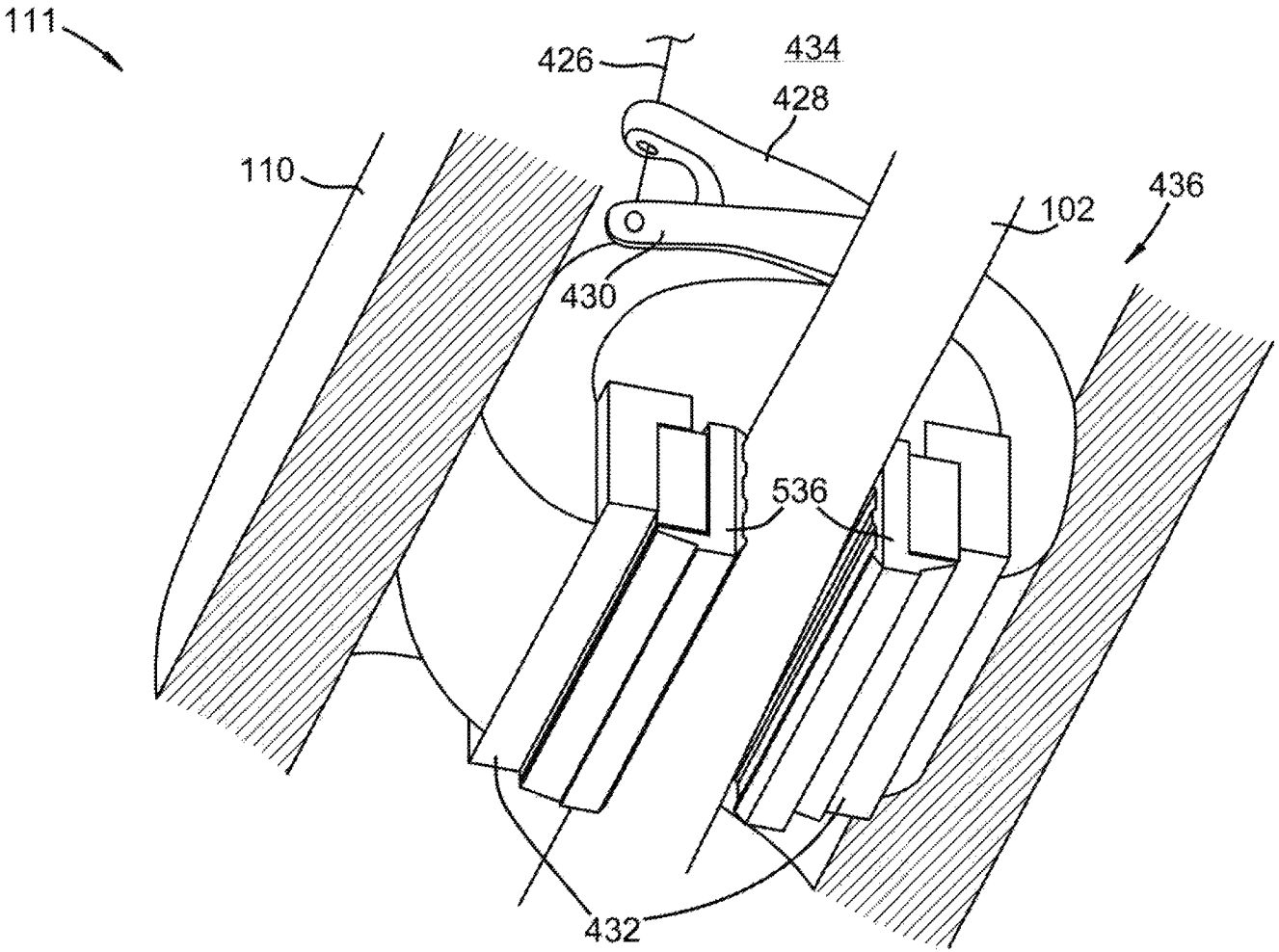
FIG. 5A is a cross-sectional view of an orifice of a fairlead comprising a cable-wiping apparatus, according to one embodiment.

FIG. 5A is a cross-sectional view of a cavity 436 of a fairlead 111 within the guide 110 comprising a cable-wiping apparatus 434, according to one embodiment. The cable-wiping apparatus 434 may be positioned within the cavity 436 such that the top caliper arm 428 and the bottom caliper arm 430 have sufficient room to move in response to mechanical torque applied by the inner cable 426, according to one embodiment. The one or more clamp shoes 432 may include a jaw surface 536 that simultaneously permits the cable 102 to be pulled in while actively compressing around the cable 102 such that debris may be wiped off from the cable 102.

Figure 5B:
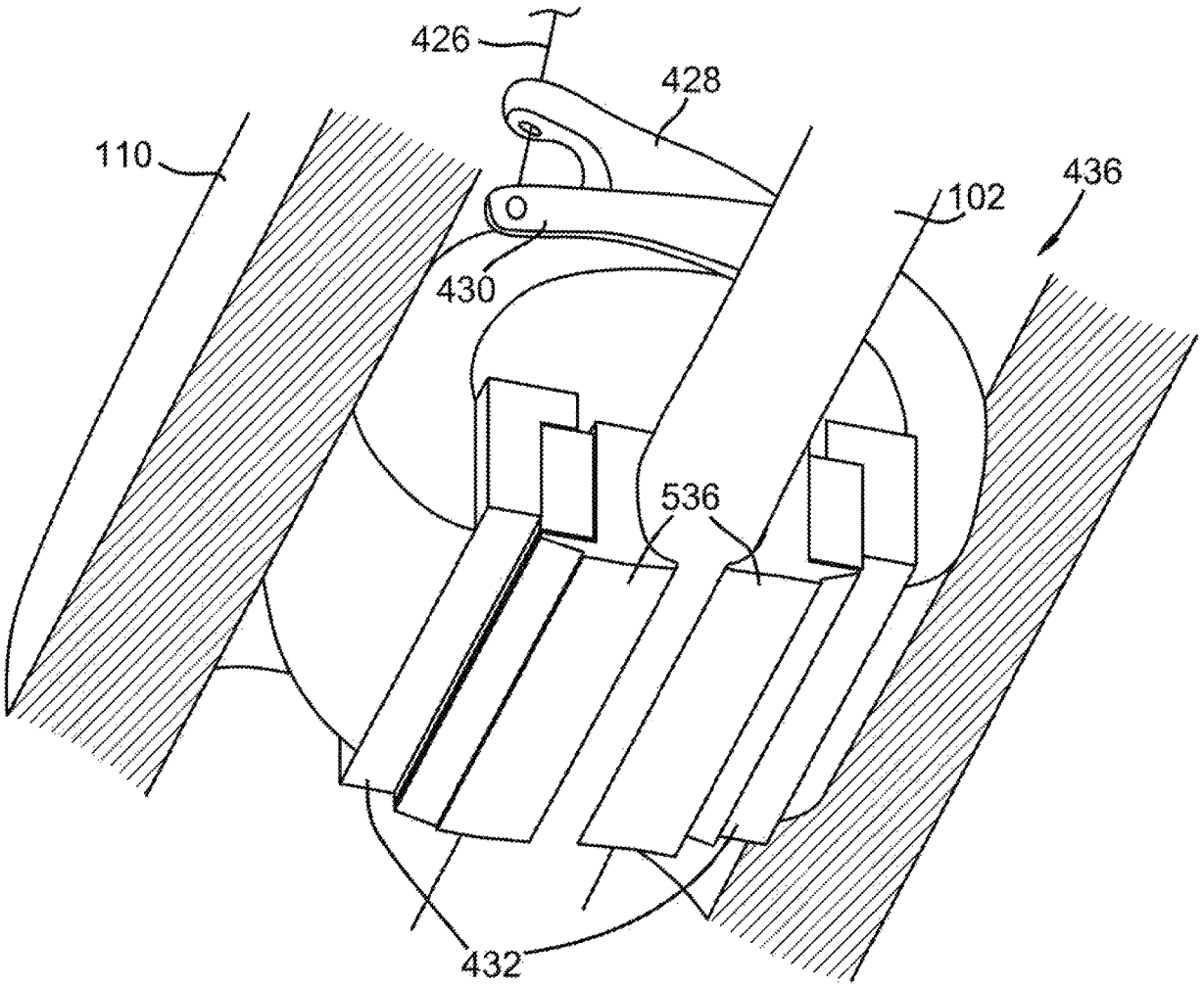
FIG. 5B is a cross-sectional view the cable-wiping apparatus of FIG. 5A with an alternative jaw surface.

FIG. 5B is a cross-sectional view the cable-wiping apparatus 434 of FIG. 5A with an alternative jaw surface 536. The jaw surface 536 may be contoured to encompass the entirety of cable 102 circumference, or provide any varying degree of coverage of the circumference. The top caliper arm 428 and the bottom caliper arm 430 may control the amount of pressure applied to the cable 102 and/or whether the jaw surface 536 is in contact with the cable 102.

Figure 6:
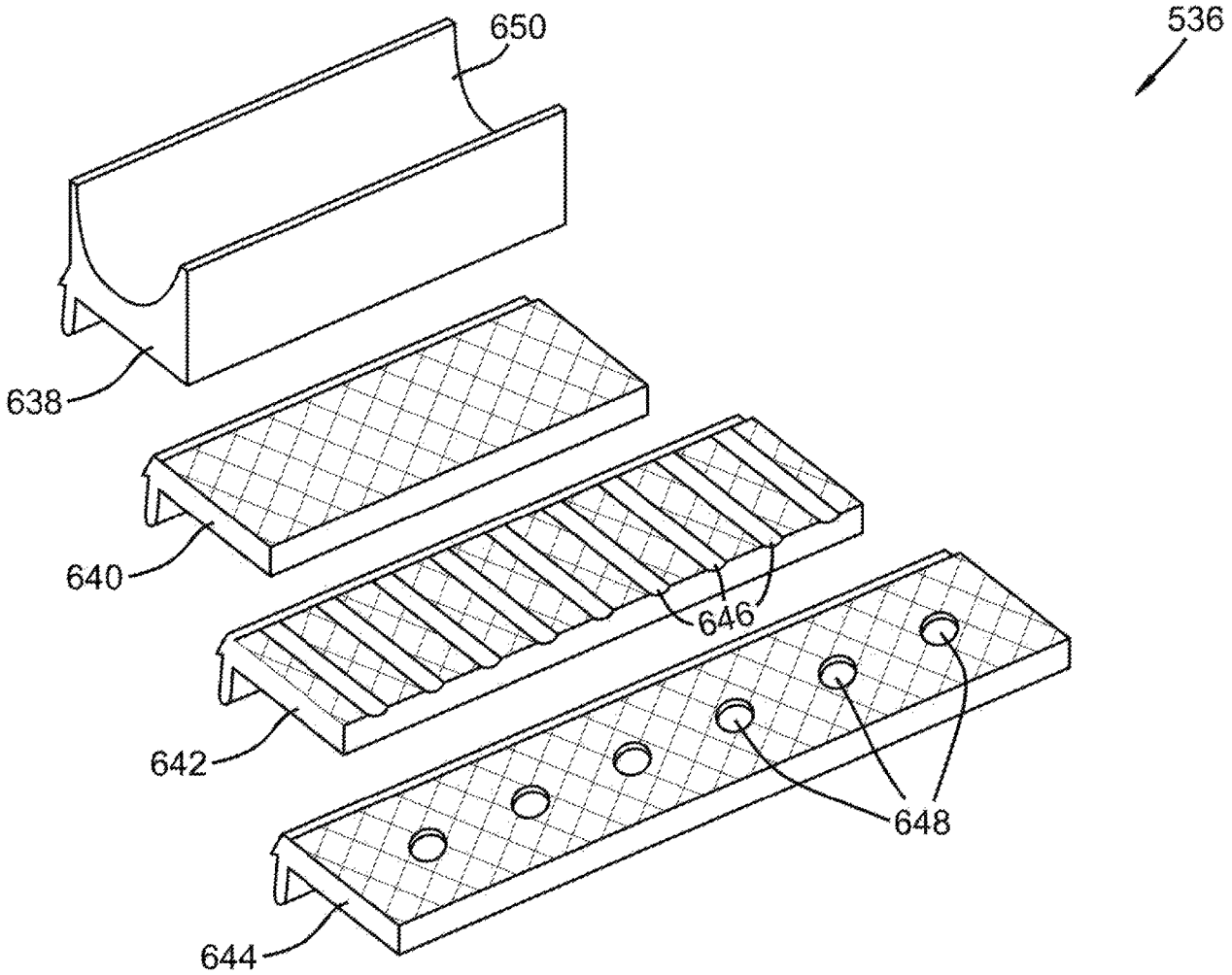
FIG. 6 is an isometric view of several embodiments for jaw surfaces for the cable-wiping apparatus.

FIG. 6 is an isometric view of several embodiments for jaw surfaces 536 for the cable-wiping apparatus 434 (see FIGS. 5A and 5B). In one embodiment, the jaw surface 638 may be concave in shape such that each jaw surface 638 curves around the cable 102 (see FIG. 5B). In another embodiment, the jaw surface 640 may be planar such that there is little friction applied to the cable 102 (see FIG. 5B). In another embodiment, the jaw surface 642 may includes one or more depressions 646. Alternatively, in another embodiment, the jaw surface 644 may be porous, and include one or more apertures 648 through which dirt, mud, debris, or other materials may permeate during wiping. According to various embodiments, the jaw surface 642 may include rubber, plastic, polypropylene, polyvinyl chloride, acrylonitrile butadiene styrene, polyurethane, latex, or other similar materials.

Figure 7A:
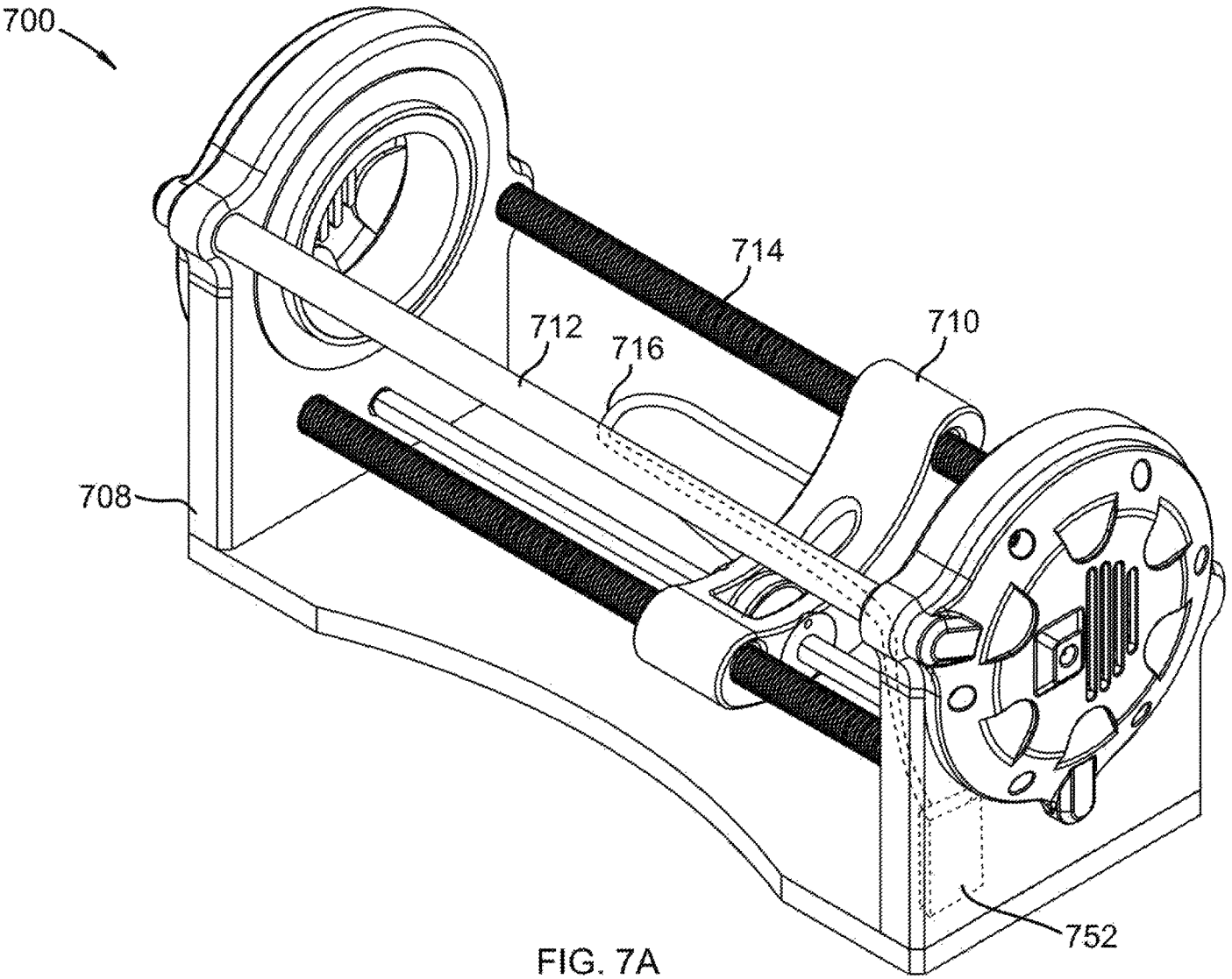
FIG. 7A is an isometric view of a winch, according to one embodiment, with the drum removed comprising a lithium-ion battery.

FIG. 7A is an isometric view of a winch 700, according to one embodiment, with the drum removed, comprising a lithium-ion battery 752. The lithium-ion battery 752 may be positioned within the frame 708. Electric wires 716 may pass through the frame 708 and the support rod 712. In various embodiments, the electric wires 716 may enter into the guide 710 and have sufficient slack such that when the guide 710 moves along the guide rods 714 the electric wires 716 do not impede the movement of the guide 710. In various embodiments, the lithium-ion battery 752 may be removable from the frame 708 and rechargeable. In some embodiments, the frame 708 may include a port through which the lithium battery may be charged.

Figure 7B:
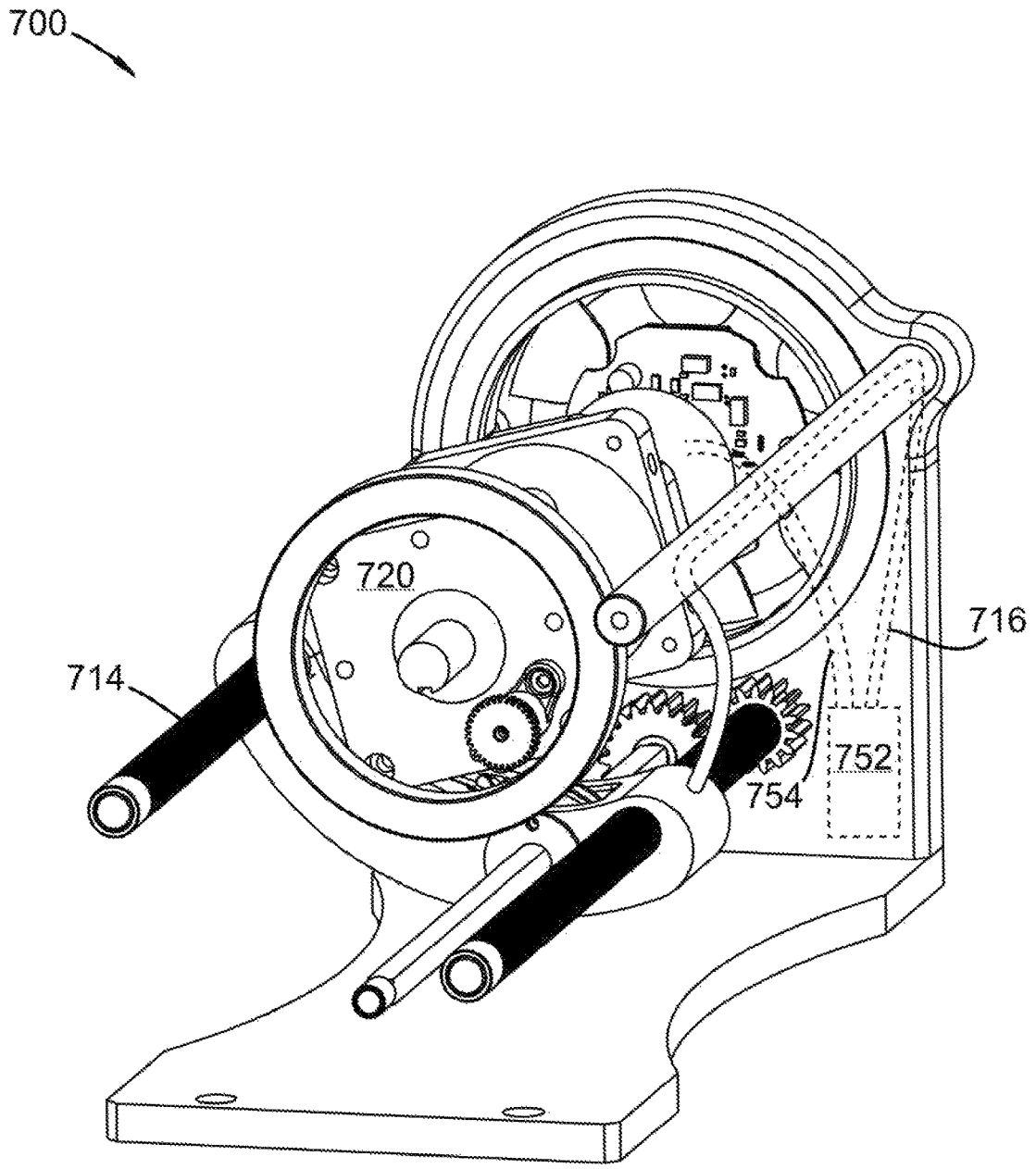
FIG. 7B is a cross sectional view of the winch of FIG. 7A.

FIG. 7B is a cross sectional view of the winch 700 of FIG. 7A. In one embodiment, one lithium-ion battery 752 may serve as an electric power source for the entire winch 700. One electric wire 716 may provide power to the actuator (not shown) while another electric wire 754 may power rotation of the tension motor 720 and help in guiding the cable 102 (not shown) along the length of the guide rods 714. In another embodiment, the lithium-ion battery 752 may only power the actuator (not shown) and a separate power source may be contained within the tension motor 720.

Figure 7C:
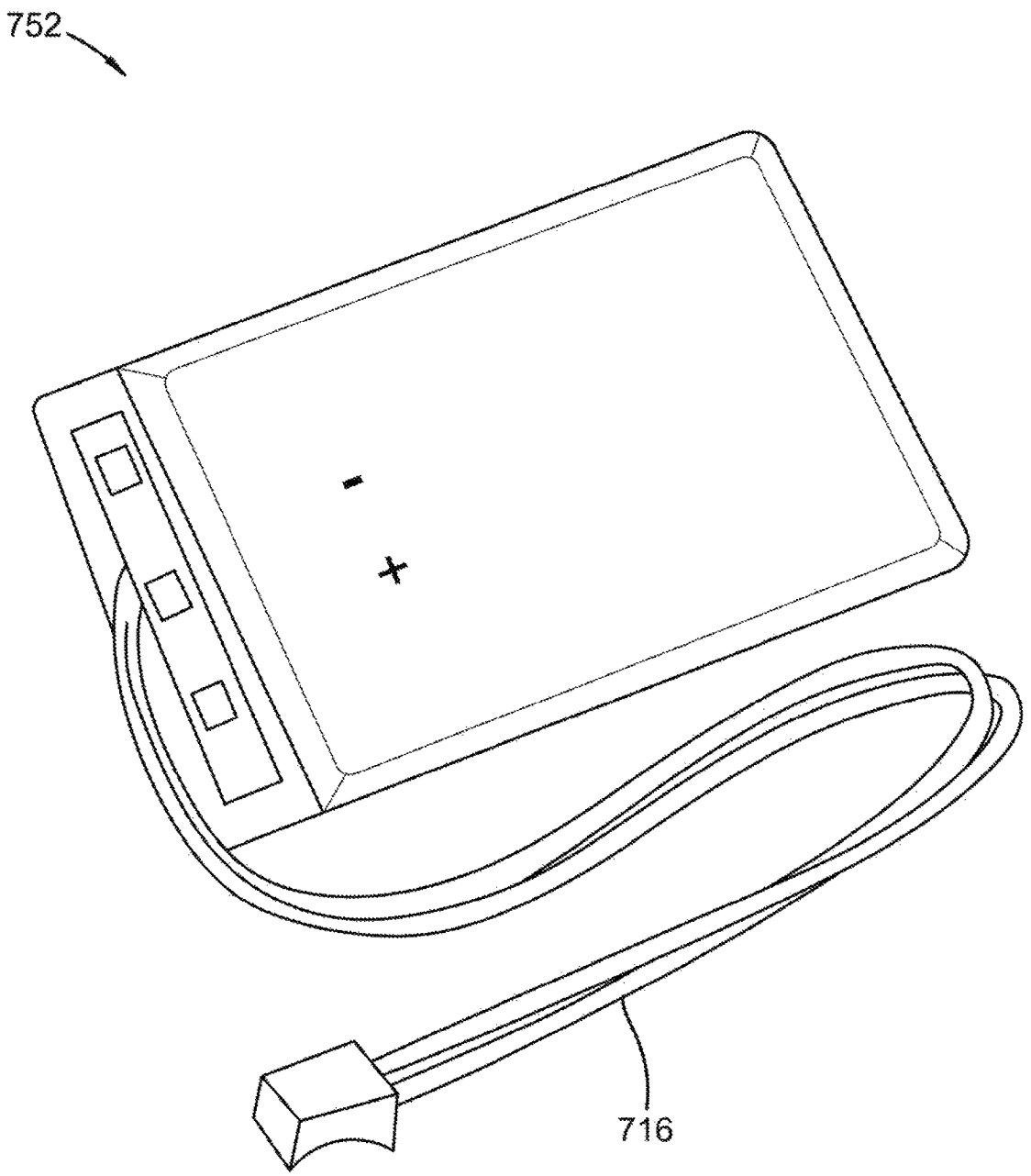
FIG. 7C is a lithium-ion battery, according to one embodiment, that may be comprised within a winch.

FIG. 7C is a lithium-ion battery, according to one embodiment, that may be comprised within a winch (see FIGS. 7A and 7B). The lithium-ion battery 752 may comprise any number of shapes including, but not limited, small cylindrical, large cylindrical, pouch, or prismatic shapes. In one embodiment, the lithium-ion battery 752 may include a cathode having a cathode-active material, an anode having an anode-active material, and a nonaqueous electrolyte having an ionic salt of the anode-active material dissolved therein.

The invention claimed is:

1. A winch, comprising:

a rotatable drum for winding and unwinding a first cable therefrom;

a cable guide for positioning said cable onto the drum;

the cable guide comprising a cable-wiping apparatus;

the cable-wiping apparatus comprising:

one or more actuators powered by an electricity source that also powers rotational movement of the drum, and wherein the one or more actuators are activated only when the drum rotates in a direction for winding the cable onto the drum;

a second cable for transmitting a mechanical force comprising an inner cable positioned within an outer cable housing and operatively connected to at least one actuator;

a wiper clamp operatively connected to the second cable and positioned near the first cable;

wherein the wiper clamp comprises at least one jaw surface that is in contact with the first cable when the first cable is pulled in.

2. The winch of claim 1, wherein the electricity source is a lithium-ion battery.

3. The winch of claim 2, wherein the lithium-ion battery is small cylindrical, large cylindrical, pouch, or prismatic in shape.

4. The winch of claim 2, wherein the lithium-ion battery is rechargeable.

5. The winch of claim 1, wherein the shape of the jaw surface is concave, planar, porous, and/or include one or more depressions.

6. The winch of claim 1, wherein the jaw surface is comprised of rubber, plastic, polypropylene, polyvinyl chloride, acrylonitrile butadiene styrene, polyurethane, or latex.

7. The winch of claim 1, wherein the cable-wiping apparatus comprises a side-pull clamping mechanism.

8. The winch of claim 1 further comprising a tension motor for rotating the drum.

9. The winch of claim 8, wherein the tension motor is operatively connected to the same power source as the actuator.

10. The winch of claim 1, wherein the second cable is a flexible metal cable comprising a composite outer cable housing, a longitudinal incompressible layer.

11. A winch, comprising:

a rotatable drum for winding and unwinding a first cable therefrom;

a first electricity source operatively connected to a tension motor located within the drum;

a cable guide for positioning said cable onto the drum;

the cable guide comprising a cable-wiping apparatus;

the cable-wiping apparatus comprising:

one or more actuators powered by a second electricity source located internal to the winch;

wherein the one or more actuators are activated only when the drum rotates in a direction for winding the cable onto the drum;

a second cable for transmitting a mechanical force comprising an inner cable positioned within an outer cable housing and operatively connected to at least one actuator;

a wiper clamp operatively connected to the second cable and positioned near the first cable;

wherein the wiper clamp comprises at least one jaw surface that is in contact with the first cable when the first cable is pulled in.

12. The winch of claim 11, wherein the second electricity source is a lithium-ion battery.

13. The winch of claim 12, wherein the lithium-ion battery is small cylindrical, large cylindrical, pouch, or prismatic in shape.

14. The winch of claim 12, wherein the lithium-ion battery is rechargeable.

15. The winch of claim 12, wherein the lithium-ion battery is located within a frame that supports the drum.

16. The winch of claim 11, wherein the first electricity source is located external to the winch.

17. The winch of claim 11, wherein the cable-wiping apparatus comprises a side-pull clamping mechanism.

18. The winch of claim 11, wherein the shape of the jaw surface is concave, planar, porous, and/or include one or more depressions.

19. The winch of claim 11, wherein the jaw surface is comprised of rubber, plastic, polypropylene, polyvinyl chloride, acrylonitrile butadiene styrene, polyurethane, or latex.

20. The winch of claim 11, wherein the second cable is a flexible metal cable comprising a composite outer cable housing, a longitudinal incompressible layer.

* * * * *